United States Patent [19]

MacTaggart

[11] 3,980,517

[45] Sept. 14, 1976

[54] CONTINUOUS ON-MACHINE CONTROL OF BLEACHING CHEMICALS

[75] Inventor: John W. MacTaggart, Bolton, Canada

[73] Assignee: Sentrol Systems Ltd., Downsview, Canada

[22] Filed: Aug. 4, 1975

[21] Appl. No.: 601,288

Related U.S. Application Data

[63] Continuation-in-part of Ser. No. 489,368, July 17, 1974, abandoned.

[52] U.S. Cl. ..... 162/49; 162/238; 162/252; 162/DIG. 10; 356/208; 356/212; 356/243

[51] Int. Cl.[2] ..... D21C 7/14

[58] Field of Search ..... 162/253, 238, 49, 252, 162/DIG. 10; 68/13 R; 356/208, 209, 212, 243, 72

[56] References Cited

UNITED STATES PATENTS

| | | | |
|---|---|---|---|
| 3,465,550 | 9/1969 | Strom et al. | 162/238 |
| 3,729,375 | 4/1973 | Chappelle | 162/252 |

OTHER PUBLICATIONS

Burnett, J. C., "Computer Control of the Chlorine Stage", Pulp and Paper Magazine of Canada, vol. 71, No. 14, July 17, 1970, pp. 57–62.

*Primary Examiner*—S. Leon Bashore
*Assistant Examiner*—George C. Yeung
*Attorney, Agent, or Firm*—Shenier & O'Connor

[57] ABSTRACT

In a multi-stage bleaching system in which respective bleaching chemicals are added to the stock in various stages, apparatus in which in the first stage in which chlorine is added to the brown stock, the first of a pair of sensing units associated with the stage comprises a source of red light directed onto the incoming brown stock and a suitable detector for sensing light scattered from the stock to produce a first signal representative of the brightness of the incoming stock and the second similar sensing unit of the pair senses the brightness of the stock immediately following the addition of chlorine to produce a second signal. The first and second signals are compared to produce a difference signal indicative of the change in brightness independently of the condition of the incoming stock and this difference signal is compared with a set point standard to provide a control signal for regulating the addition of the chlorine to the brown stock.

11 Claims, 4 Drawing Figures

CONTINUOUS ON-MACHINE CONTROL OF BLEACHING CHEMICALS

RELATED APPLICATION

This application is a continuation in part of my copending application Ser. No. 489,368, filed July 17, 1974, now abandoned, for CONTINUOUS ON-MACHINE CONTROL OF BLEACHING CHEMICALS.

BACKGROUND OF THE INVENTION

In the art of making paper, a cellulose fibre pulp slurry first is prepared by a known method. In order to produce high quality paper from the thus prepared pulp slurry, the brown stock must be bleached. The difficulty in the bleaching process is to remove the coloring matter without at the same time attacking the cellulose. In order to achieve this operation in the prior art, the bleaching is carried on in a number of stages. In the first stage, chlorine is added to the brown stock. Next, a sodium hydroxide alkaline wash is applied to remove the alkali-soluble chlorinated lignin compounds produced in the step of adding the chlorine. The next bleaching agent which is added is sodium hypochlorite. Following the sodium hypochlorite addition, chlorine dioxide is added to the stock which is again subjected to a sodium hyroxide alkaline wash to remove the alkali-soluble chlorinated lignin compounds produced in the preceding steps. Finally, in the last stage of the process additional chlorine dioxide is added to the stock to produce bleached stock from which high-quality paper can be made.

It will readily be appreciated that control of the bleaching process is desirable if high-quality results are to be produced. Some attempts have been made in the prior art to provide such controls. For example, chemical analysis of the stock at some point in the process affords an indication of the amount of bleaching compound which should be added to produce desired results. Such a control arrangement, however, is a secondary control rather than a primary control and suffers from all of the disadvantages of such a secondary control.

Chappelle U.S. Pat. No. 3,729,375, shows a system for controlling the addition of chlorine dioxide in the last stage of the bleaching process. Chappelle measures the brightness of the stock being fed into the last stage and compares the signal with a reference signal representing the desired brightness of stock leaving the last stage to obtain a difference signal. The difference signal is multiplied by a factor K to obtain a control signal which actuates a motor operated valve to regulate the addition of chlorine dioxide in the last stage. The factor K accounts for the temperature and rate of flow of the slurry and the chemical strength of the bleaching agent. Chappelle then measures the brightness of the stock leaving the last stage and compares it with the same standard to obtain a second difference signal which is used to modify the factor K to to reduce the second difference signal to zero. As is recognized by the patentee, the reaction time in this last stage is approximately 2 hours. In making his brightness measurements Chappelle uses a light source having a wavelength of 470 nanometers which is representative of the blue portion of the spectrum.

While the arrangement shown in the Chappelle patent discussed above affords some measure of control of the addition of the bleaching agent in a bleaching process, it is neither as stable nor as effective as is desired. The system is not particularly sensitive to small changes in brightness. It is relatively complicated and expensive for the result achieved thereby. It is susceptible to errors resulting from spurious factors such for example as consistency changes, species changes, black liquor contamination and to the addition of recycle bleached paper which is often added to the brown stock.

I have invented a continuous on-machine control of bleaching chemicals which overcomes the defects of systems of the prior art for controlling the addition of such chemicals. My system is not adversely effected by spurious factors such as consistency changes, species changes, black liquor contamination or the addition of recycled bleached paper to the brown stock. My system is more sensitive than are systems of the prior art. It affords primary control of the bleaching process. The sensing unit of my system has a very low temperature co-efficient. The output of the sensing unit of my system is reasonably linear with chemical concentration in the region of interest.

SUMMARY OF THE INVENTION

One object of my invention is to provide a continuous on-machine control of bleaching chemicals which is more effective than are control systems of the prior art.

Another object of my invention is to provide a continuous on-machine control of bleaching chemicals which is not adversely affected by spurious factors such as consistency changes and the like.

Another object of my invention is to provide a continuous on-machine control of bleaching chemicals which is more stable than are systems of the prior art.

A further object of my invention is to provide a continuous on-machine control of bleaching chemicals which incorporates a sensing unit having a low temperature coefficient.

A still further object of my invention is to provide a continuous on-machine control of bleaching chemicals incorporating a sensing unit, the output of which is reasonably linear with chemical concentration.

Other and further objects of my invention will appear from the following description.

In general my invention contemplates the provision of a continuous on-machine control of bleaching chemicals in which a pair of brightness sensing units are associated with the first stage of the bleaching process in which chlorine is added to the brown stock and in which a brightness signal produced by a sensor directed toward the incoming brown stock is combined with a second brightness signal derived from the stock immediately after the addition of chlorine to produce a combined signal which is compared with a standard set point signal to produce a control signal employed to regulate the addition of the chlorine in the stage. Each of the sensing units includes a source of red light positioned adjacent to a window in the pipe carrying the stock to produce reflected light which is detected by a sensor to provide the brightness signal. Each of the units also includes a standard adapted to be moved from a position out of the path from the source to a position in the path of light from the source to reflect light to the sensor to generate a standard signal.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
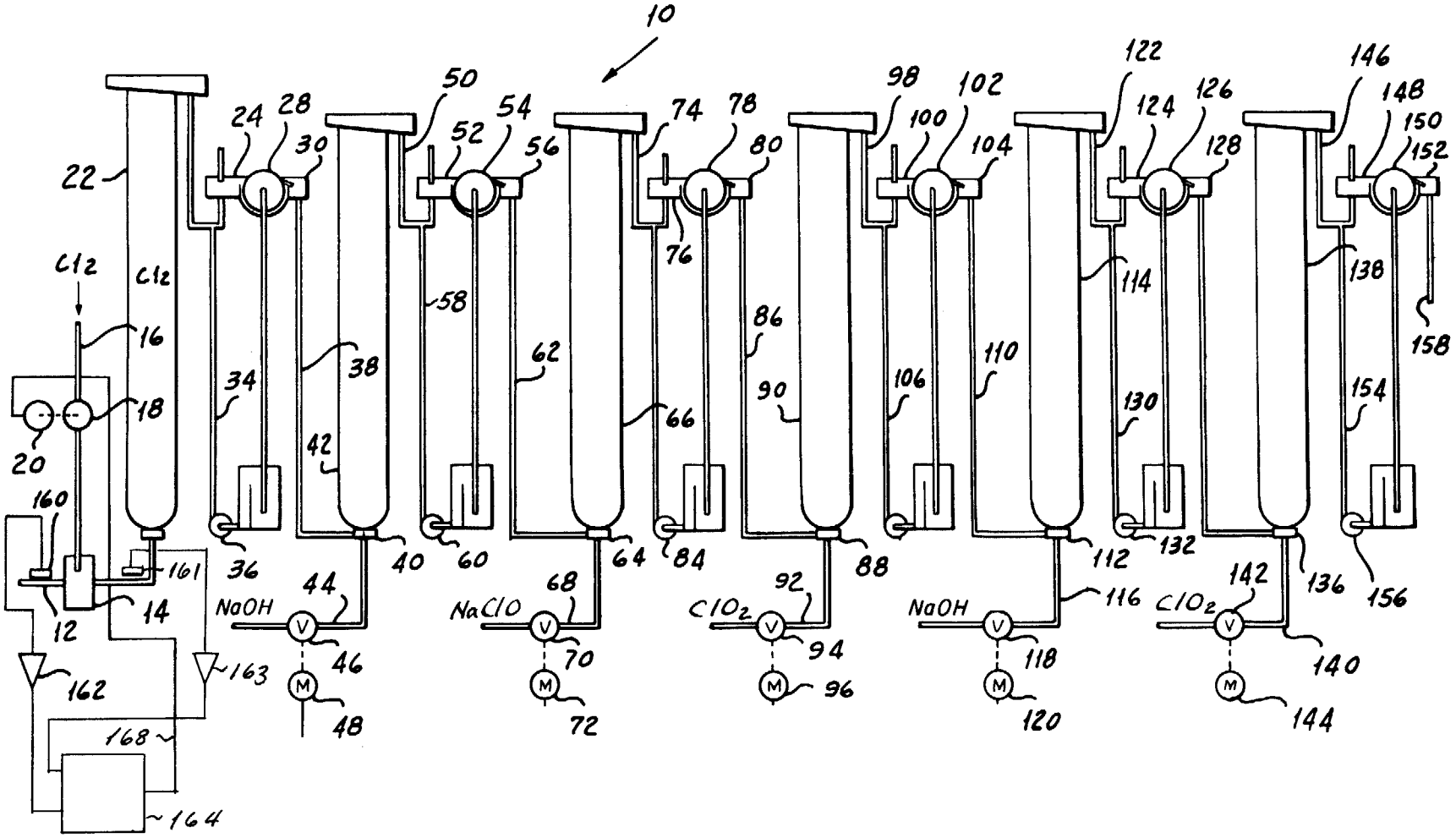
FIG. 1 is a schematic view of a multi-stage bleaching installation provided with my continuous on-machine control of bleaching chemicals.

Referring now to FIG. 1 of the drawings, a multi-stage bleaching installation indicated generally by the reference character 10 which may be provided with my control includes an inlet pipe 12 carrying brown stock produced by the pulping process known to the art. From the pipe 12 the stock flows into a blending box 14. An input pipe 16 is adapted to supply chlorine to the blending box 14 through a valve 18 adapted to be operated by a motor 20 in a manner to be described. The mixture of chlorine and brown stock flows from the blending box into a tank 22 from which it is fed to a chest 24 of a type known in the art. From the chest 24 the pulp is collected on a vacuum-forming drum 28 provided with a recirculating pump 36 which returns liquid to the inlet of box 24 through a return pipe 34.

From the drum 28, the stock passes to a chest 30 connected by a line 38 to the inlet 40 of a tank 42. A line 44 is adapted to supply sodium hydroxide to the inlet 40 through a valve 46 operated by a motor 48 in a manner to be described. From the top of the tank 42 the stock is fed by a line 50 to a chest 52. A vacuum-forming drum 54 associated with the chest 52 collects the pulp and feeds it to a chest 56. Drum 54 is provided with a return line 58 from which liquid is pumped by pump 60 to the inlet line 50.

An outlet line 62 feeds stock from the chest 56 to an inlet fitting 64 on the bottom of a tank 66. A line 68 is adapted to conduct sodium hypochlorite through a valve 70 to the inlet 64 of the tank 66. A motor 72 operates the valve 70 in a manner to be described to control the flow of sodium hypoclorite into the tank 66.

Stock from the tank 66 passes through a pipe 74 to a chest 76 having a vacuum drum 78 associated therewith. From the drum 78, the pulp passes into a chest 80. A pump 84 associated with the drum 78 feeds liquid back into the inlet pipe 74. From the chest 80 stock passes outwardly through a pipe 86 to an inlet fitting 88 at the lower end of a tank 90. A pipe 92 is adapted to supply chlorine dioxide to the tank 90 through a valve 94 controlled by a motor 96 in a manner to be described.

From the tank 90, the stock flows outwardly through a pipe 98 to a chest 100 having a vacuum drum 102 associated therewith. From the drum 102, pulp passes into a chest 104. A pump 108 recirculates liquid from the drum 104 to a pipe 106 connected to the inlet pipe 98.

A pipe 110 conducts stock from the chest 104 to an inlet fitting 112 at the bottom of tank 114. A pipe 116 is adapted to conduct sodium hydroxide to the tank 114 through a valve 118 controlled by a motor 120. Stock from the tank 114 flows through a pipe 122 into a chest 124 having a vacuum drum 126 associated therewith. From the drum the pulp passes to an outlet chest 128. A pump 132 recirculates liquid from the drum 126 to a line 130 connected to the input pipe 122.

In the final stage, stock from the chest 128 is fed to an inlet fitting 136 of a tank 138. A pipe 140 is adapted to conduct chlorine dioxide through a valve 142 to the tank 138. A motor 144 controls valve 142 in a manner to be described. From the tank 138 the stock flows through a pipe 146 to a chest 148. A vacuum drum 150 carries pulp from the chest 148 to an outlet chest 152. A pump 156 circulates liquid from the drum 150 to a pipe 154 leading to the inlet pipe 146. The fully bleached stock from the chest 152 flows outwardly through a line 158 to the paper making machine (not shown).

As is pointed out hereinabove, the reaction time constant or the time between which a brightness measurement is made and the time at which the resultant control becomes effective, in the last stage of the bleaching process is approximately two hours. The time constant in the earlier stages of the process is progressively smaller and in the first or chlorination stage is of the order of two seconds. Moreover, the minimum feedback time constant for electronic control circuitry employing present-day technology is of the order of one microsecond and controls can be tuned to any value above this. Normally, process control circuitry is tuned to a time constant of about two seconds.

In my system for controlling the bleaching operation, I perform the first control operation at the first or chlorination stage. In so doing, I place a first sensing unit 160 in the incoming brown stock line 12 to provide a brightness signal which is amplified by an amplifer 162. Further, I measure the brightness of the chlorinated stock immediately after chlorination by placing a second sensing unit 161 in the output line from the blending box 14. The signal from the sensing unit 161 is amplified by an amplifier 163 and is applied to a control signal unit 164, together with the signal from amplifier 162.

Figure 4:
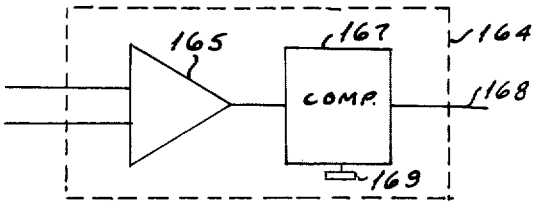
FIG. 4 is a schematic view of the control circuitry associated with one of the stages of the multi-stage bleaching installation with which my continuous on-machine control of bleaching chemicals is employed.

Referring now to FIG. 4, the unit 164 includes, for example, a differential amplifier 165 which receives as its inputs the outputs from amplifiers 162 and 163. Amplifier 165 provides an output signal representing the difference between the two brightness signals from the sensing unit 160 and 161. I apply the output of the differential amplifier 165 to a comparison circuit 167 to any suitable type known to the art. This network 167 compares the output of the differential amplifier 165 with a set point signal representing the desired change in brightness as a result of the addition of chlorine in the first stage of the process. This set point signal may be set into the network 167, either automatically or manually by means of the control 169. Network 167 provides an output control signal representing the deviation of the difference signal from amplifier 165 from the set point standard. This signal is applied by a line 168 to the motor 20 associated with the valve 18 which controls the addition of chlorine. Owing to the fact that the reaction time constant in this first stage is extremely small the system is most reliable and effective. Moreover, owing to the fact that I generate a difference signal which represents the difference in brightness between the brown stock and chlorinated stock, my control is not affected by spurious conditions such, for example, as consistency change, species change, black liquor contamination, or the addition of recycled bleached paper to the brown stock. That is to say, my error signal is affected only by changes in the optical properties of the pulp caused by the action of the bleaching agent. This will readily be appreciated upon consideration of the fact that in the bleaching process the bleaching agent affects only the fibrous material in the slurry and not the carrier. The difference signal technique enables us to determine the effect of the bleaching agent on the fibrous material independently of the color of the carrier for example, and its effect among others on the brightness measurement per se.

While I have discovered that use of the control system described including the pair of sensing units 160 and 161 for providing a difference signal at the first stage of the bleaching process greatly improves the results achieved in the overall process, this control arrangement may advantageously be carried on throughout the remaining stages of the bleaching system, if desired.

It will readily be appreciated by those skilled in the art that while I have shown an arrangement in which the brightness signals are subtracted, the input and output brightness signals may be combined in other ways, such for example, as by multiplication and then compared with an appropriate set point signal to afford control.

Figure 3:
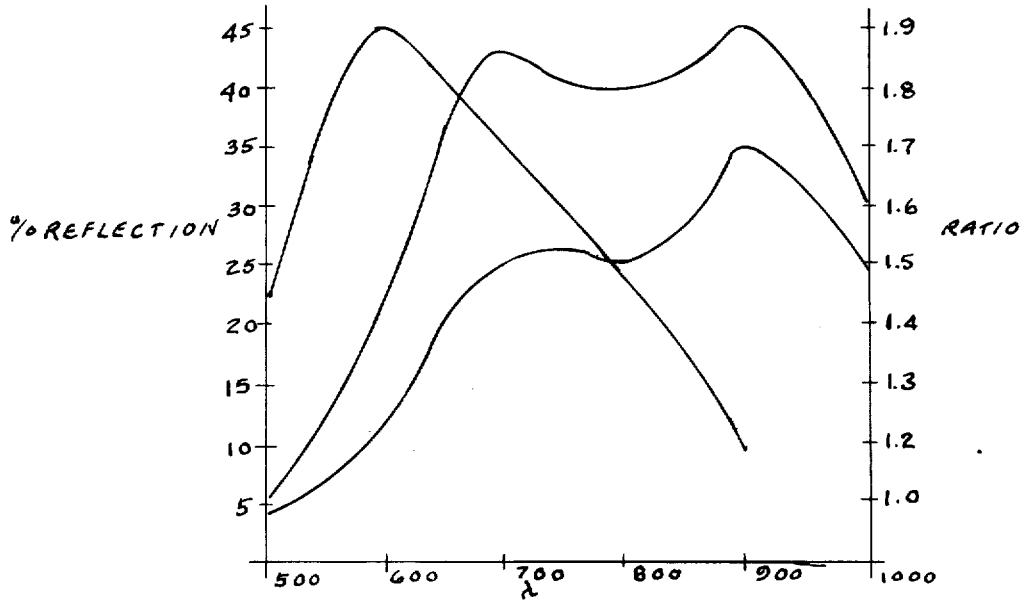
FIG. 3 is a graph illustrating the sensitivity of brightness measurements at various wavelengths of incident light in the first stage of a multi-stage bleaching process.

I have discovered that in the first stage of the bleaching process in which chlorine is added to the brown stock that the peak in the spectural sensitivity curve of optical reflectance versus bleaching occurs at a wavelength near 670 nanometers. There is outlined below and shown in FIG. 3 the results of tests carried out at various wavelengths from 500 nanometers to 1000 nanometers on brown stock, both before and after chlorination.

| Wavelength (nanometers) | Background | Brightness Brown Stock | Chlorinated | Ratio |
|---|---|---|---|---|
| 500 | 13.5 | 18 | 21 | 1.45 |
| 600 | 16.5 | 28.7 | 39.7 | 1.9 |
| 700 | 17 | 42.4 | 61.1 | 1.7 |
| 800 | 16.4 | 42 | 56 | 1.55 |
| 900 | 15.6 | 48.1 | 61.2 | 1.23 |
| 1000 | 15.9 | 40 | 48.4 | 1.30 |

The ratio indicated in the righthand column of the table is derived by subtracting the background measurement from each of the two brown stock and chlorinated stock brightness measurements and then dividing the latter result by the former result. As can be seen from FIG. 3 the highest ratio occurs at a wavelength of about 600 nanometers and that the ratio at 700 nanometers is relatively close to this peak value. Moreover, there are available light emitting diodes which emit light at a wavelength of at or near 670 nanometers. I employ such a light emitting diode in each of my sensing units, such as the unit 160. In so doing, I am able to obtain sensitive measurements without the need for a narrow band filter or the like. Moreover, such a light emitting diode is of high intensity and has a long life in use.

In addition to the foregoing, I have discovered in this first stage of the bleaching process that use of light of a wavelength of 670 nanometers representative of the red portion of the spectrum affords a brightness measurement at least four times as sensitive as does light at 457 nanometers, representative of the blue portion of the spectrum. Moreover, a measurement using red light is twice as sensitive in stage 2 and equally sensitive to one using blue light in the subsequent stages of the bleaching process.

Figure 2:
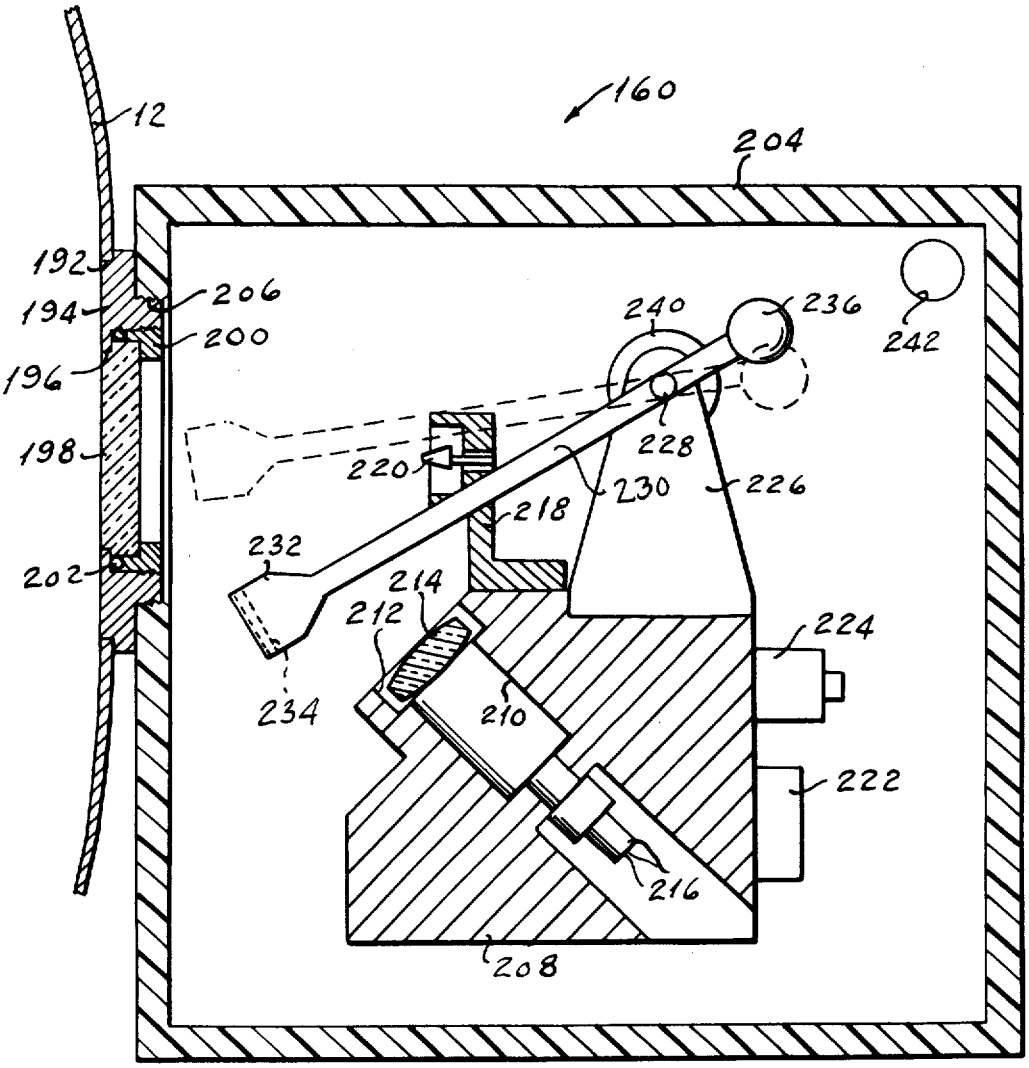
FIG. 2 is a sectional view of one of the sensing units of my continuous on-machine control of bleaching chemicals.

Referring now to FIG. 2, I have shown details of the sensing unit 160. The pipe 12 with which the unit 160 is associated is provided with an opening 192 in which I secure a window-mounting flange 194 by any suitable means, such for example as by welding. Flange 194 has an opening 196 in which I mount a window formed of any suitable material, such for example as "Pyrex", which is the registered trademark of Corning Glass Works, Corning, New York, for a class of high-temperature borosilicate glasses having varied properties. A retaining ring 200 screwed into the opening 196 behind the window 198 holds the window in place. Preferably, I position a sealing member such as an O-ring 202 around the window between the ring 200 and the mounting flange 194. Flange 194 is received by threads 206 in an opening in housing 204. Housing 204 carries a mounting block 208 formed with a bore 210 provided with an enlarged recess 212 at one end thereof for receiving a light-collecting lens 214. Lens 214 is adapted to focus light on a detector 216 of any suitable type known to the art which is responsible to visible radiation.

A bracket 218 secured to the mounting block 208 by any suitable means supports a light source 220 which may, for example, be a light-emitting diode which emits light at a wavelength of 670 nanometers in the red region of the spectrum. Block 208 is provided with a terminal strip 222 by means of which electrical connections can be made in any suitable manner known to the art. I may form the housing 204 from any suitable material, such for example as a polyvinyl chloride plastic. Preferably I pressurize the box with a suitable gas, such for example as nitrogen. This may be achieved through an opening 242 in the wall of the box. I mount a pressure sensing device 224 of any suitable type known to the art on the block 208 to monitor the pressure within the housing and to actuate an alarm (not shown) in the event of a leak.

A bracket 226 on the block 208 supports a pivot pin 228 carrying a lever 230 formed with a support 232 at one end thereof for receiving a standard 234 of brightness for the particular unit. It will readily be appreciated that the brightness standards 234 of the various sensing units become progressively brighter as the stock passes through the various stations. I provide the other end of lever 230 with a counterweight 236. The arrangement is such that lever 230 normally occupies the position illustrated in FIG. 2 at which it will not reflect an appreciable amount of light to the detector 216. When it is desired to generate a standard signal, a solenoid 240 is energized to rotate the lever 230 to position the standard 234 in the position illustrated in broken lines in the figure. In this position of the standard, light from the source 220 is reflected by the standard 234 toward the detector 216.

In the system illustrated in FIG. 1, the brightness figures for the various stages expressed in G. E. brightness units are 30 for the brown stock, 30 to 35 after the addition of chlorine, 40 after the first addition of sodium hydroxide, 60 to 80 after the addition of sodium hypochlorite, 80 after the first addition of chlorine dioxide, 78 after the second addition of sodium hydroxide, and 90 after the second addition of chlorine dioxide.

The operation of my continuous on-machine control of bleaching chemicals will readily be apparent from the description hereinabove. In setting the system in operation, the solenoids 240 of each of the units 160 and 161 are energized to position the standards 234 at locations at which light from the sources 220 is directed onto the standard and is reflected from the standard to the detector 216. The resultant output on line 168 may be observed in any suitable manner and the control 169 actuated to provide the proper set point signal. Next, the solenoids are de-energized and the system is in operation. The unit 164 then compares the brightness of the brown stock with the brightness of the stock immediately after chlorination and in accordance with the setting of control 169 provides an output on conductor 168 which operates motor 20 to open valve 18 to provide the chlorination required to produce the desired brightness change resulting from the addition of chlorine.

It is to be noted as is pointed out hereinabove that in my arrangement control is provided at the first stage of the process where the reaction time constant is small so that a stable and effective on-line control is provided. Moreover, the use of a source of light in the red region of the spectrum is much more sensitive in this primary stage of the process than is the blue light generally used in the prior art. My arrangement has a low consistency dependence. As a matter of fact, it has been actually measured to give less than two percent change in brightness reading for a fifteen percent change in consistency.

Further as is pointed out hereinabove, while my system affords far superior results in the first stage of the process in which chlorine is added to the brown stock, I may as well use the arrangement in subsequent stages.

It will be seen that I have accomplished the objects of my invention. I have provided a continuous on-machine control of bleaching chemicals which is an improvement over control systems of the prior art. My system provides a more stable and more effective on-line control than do systems of the prior art. It has a low temperature coefficient. It has a low consistency dependence.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a bleaching system including a stage in which a bleaching agent is added to stock flowing through said stage, apparatus for controlling the addition of said bleaching agent in said stage including in combination, regulatable means for adding said bleaching agent in said stock in said stage, first brightness sensing means located upstream of said bleaching agent adding means in the direction of flow of said stock through said stage for producing a first signal representing the brightness of stock being fed to said stage prior to the addition of said bleaching agent in said stage, second brightness sensing means located downstream of said bleaching agent adding means in the direction of flow of said stock through said stage for producing a second signal representing the brightness of said stock following the addition of said bleaching agent, means for combining said first and second signals to provide a control signal, and means responsive to said control signal for regulating said means for adding said bleaching agent.

2. Apparatus as in claim 1 in which said stage is the first stage of said system in which said incoming stock is brown stock.

3. Apparatus as in claim 1 in which each of said brightness sensing means including a source of light in the red region of the spectrum.

4. Apparatus as in claim 1 in which said stage is the first stage of said system in which said incoming stock is brown stock, and in which each of said brightness sensing means includes a source of light in the red region of the visible spectrum.

5. Apparatus as in claim 4 in which each of said sources of red light is a light emitting diode emitting light at a wavelength of approximately 670 nanometers.

6. Apparatus as in claim 1 in which each of said brightness sensing means comprises a source of light, means for directing light from said source onto said stock, means for sensing light reflected from said stock to produce a brightness signal, a brightness standard, means mounting said standard for movement between a first position at which it reflects no appreciable amount of light from said source to said sensing means and a second position at which an appreciable amount of light from said source is reflected by said standard to said sensing means, means normally biasing said standard to said first position, and means for moving said standards to said second position against the action of said biasing means.

7. Apparatus as in claim 6 in which said mounting means comprises an arm mounted for pivotal movement.

8. Apparatus as in claim 7 in which said moving means is a solenoid.

9. Apparatus as in claim 1 in which said signal combining means comprises means for subtracting said signals to produce a difference signal as said control signal.

10. In a bleaching process in which a bleaching agent is added to brown stock, the steps of measuring the brightness of said brown stock adding said bleaching agent to said brown stock measuring the brightness of said stock after the addition of said bleaching agent, combining said measurements, and controlling the addition of said bleaching agent in response to said combination.

11. A process as in claim 10 in which each of said measuring steps comprises directing red light onto said stock.

* * * * *